US008552666B2

(12) United States Patent
Wendt et al.

(10) Patent No.: US 8,552,666 B2
(45) Date of Patent: Oct. 8, 2013

(54) SYSTEM AND METHOD FOR CONTROLLING A LIGHTING SYSTEM WITH A PLURALITY OF LIGHT SOURCES

(75) Inventors: Matthias Wendt, Wuerselen (DE); Harald J. G. Radermacher, Aachen (DE); Paul Leyten, Helmond (NL)

(73) Assignee: Koninklijke Philips N.V., Eindhoven (NL)

( * ) Notice: Subject to any disclaimer, the term of this patent is extended or adjusted under 35 U.S.C. 154(b) by 289 days.

(21) Appl. No.: 13/120,666

(22) PCT Filed: Sep. 18, 2009

(86) PCT No.: PCT/IB2009/054087

§ 371 (c)(1), (2), (4) Date: Mar. 24, 2011

(87) PCT Pub. No.: WO2010/035192

PCT Pub. Date: Apr. 1, 2010

(65) Prior Publication Data

US 2011/0169413 A1 Jul. 14, 2011

(30) Foreign Application Priority Data

Sep. 26, 2008 (EP) ..... 08165257

(51) Int. Cl.
*H05B 37/00* (2006.01)

(52) U.S. Cl.
USPC ..... 315/312; 315/317; 315/323; 315/297; 315/152

(58) Field of Classification Search
USPC ..... 315/152, 210, 312, 317, 323; 362/520, 362/509, 511, 545, 559, 615, 646, 249.02
See application file for complete search history.

(56) References Cited

U.S. PATENT DOCUMENTS 7,277,609 B2 * 10/2007 Cassarly ..... 385/31
7,348,949 B2 3/2008 Lee et al.

(Continued)

FOREIGN PATENT DOCUMENTS

GB 2418482 A 3/2006
WO 2006111927 A1 10/2006
WO 2006111930 A2 10/2006

(Continued)

*Primary Examiner* — Vibol Tan
(74) *Attorney, Agent, or Firm* — Mark L. Beloborodov

(57) ABSTRACT

The invention relates to the controlling of a lighting system with a plurality of light sources, particularly to the semi-automatic commissioning of light sources of the lighting system or controlling of the creation of lighting scenes with the lighting system. A basic idea of the invention is to use a spatial coding of light for controlling a lighting system, particularly for commissioning of light sources of the lighting system instead of or in addition to the temporal light coding as applied in the prior art. An embodiment of the invention relates to a system for controlling a lighting system with a plurality of light sources (1, 2) comprising a light system controller (5) for controlling the light sources in that a spatial light pattern (11, 12, 21, 22) is created, which codes one or more attributes (512) of the light sources (511), and a light pattern capturing device (3) for capturing the created spatial light pattern and communicating (32, 52) with the light system controller (5) in order to enable the controlling of the one or more light sources based on the captured spatial light pattern. A spatial coding is particularly suitable for wall-washer light sources, and thus especially assists personnel in commissioning wallwasher light sources of a lighting system.

10 Claims, 9 Drawing Sheets

(56) References Cited

U.S. PATENT DOCUMENTS

| | | | | |
|---|---|---|---|---|
| 8,063,750 | B2 * | 11/2011 | Knibbe | 340/286.02 |
| 2006/0049935 | A1 | 3/2006 | Giannopoulos | |
| 2006/0062582 | A1 | 3/2006 | Suzuki et al. | |

FOREIGN PATENT DOCUMENTS

| | | | |
|---|---|---|---|
| WO | 2006111934 | A1 | 10/2006 |
| WO | 2007017811 | A2 | 2/2007 |
| WO | 2007095740 | A1 | 8/2007 |

* cited by examiner

| 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|
| S0 | S1 | S2 | S3 | S4 | S5 | 0L | 0H | 1L | 1H | 2L | 2H | 3L | 3H | 4L | 4H |
| 1 | 0 | 1 | 1 | 1 | 0 | 1 | 0 | 0 | 1 | 1 | 0 | 1 | 0 | 0 | 1 |

FIG. 2

| color | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|
| Red | 1 | 1 | 1 | 0 | 1 | 0 | 1 | 0 | 1 | 0 | 1 | 0 | 1 | 0 | 1 | 0 |
| green | B0 | B1 | B2 | B3 | B4 | B5 | B6 | B7 | B8 | B9 | B10 | B11 | B12 | B13 | B14 | B15 |
| bleu | T0 | T1 | T2 | T3 | T4 | T5 | T6 | T7 | T8 | T9 | T10 | T11 | T12 | T13 | T14 | T15 |

FIG. 3

| | |
|---|---|
| Lamp 1 | properties for Lamp 1 |
| Lamp 2 | properties for Lamp 2 |
| Lamp 3 | properties for Lamp 3 |
| ooo | ooo |
| Lamp n | properties for Lamp n |

SYSTEM AND METHOD FOR CONTROLLING A LIGHTING SYSTEM WITH A PLURALITY OF LIGHT SOURCES

FIELD OF THE INVENTION

The invention relates to the controlling of a lighting system with a plurality of light sources, particularly to the semi-automatic commissioning of light sources of the lighting system or supporting the creation of lighting scenes with the lighting system.

BACKGROUND OF THE INVENTION

For decorative lighting often a high number of light sources such as luminaries have to be installed and the control systems for these light sources have to be configured correctly in order to reproduce the proper light effects in a location. Typical lamps for such application are often controlled via a certain control bus. Several lamps are connected to the same physical or logical bus. In order to control the lamps individually, the information on the control bus is arranged in a way that a lamp can determine which part of the total information on the bus is relevant for it. Each lamp has an address; based on this address, the lamps extract the relevant data. Many installed light sources in a number of locations, mean a tedious process of determining the addresses of the different light sources and program these into the light system controller. This is required in order to guarantee an individual addressability of all the light sources for controlling the light sources with the light system controller such as changing the illumination in certain areas or of certain objects. The process of making the addresses of the different light sources known to the lighting system or the light system controller is called commissioning and is also important for support personnel, since during editing or changing of lighting scenes, it would be a very hard task for the personnel to know the addresses of light sources and to assign the desired light effects to these addresses.

WO2006/111930A1 discloses a lighting system, which comprises a controller, lighting units, and a sensing device. Each lighting unit comprises a lighting source and a modulated light source. A single light source may be used to function as both the lighting source and the modulated light source. Each modulated light source emits uniquely modulated light. A radiation pattern of each modulated light source coincides substantially with a radiation pattern of a lighting source of the same lighting unit. The sensing device is suitable to sense modulated light in a viewing area. Lighting units from which the sensing device senses modulated light are identified from the modulation of that modulated light. The sensing device measures the intensity of the modulated light from the identified lighting unit. The lighting sources are controlled dependent on control data which comprises measuring values of measured light intensities. Thus, illumination of a specific area or object can be changed without requiring from a user to know which lighting sources are responsible for a present lighting of the area or object and which lighting sources need to be controlled and to what extend for obtaining a wanted lighting for the area or object.

SUMMARY OF THE INVENTION

It is an object of the invention to provide a system and method, which allows an easy control of a lighting system with a plurality of light sources, particularly an easy commissioning of light sources of a lighting system.

The object is solved by the subject matter of the independent claims. Further embodiments are shown by the dependent claims.

A basic idea of the invention is to use a spatial coding of light for controlling a lighting system, particularly for commissioning of light sources of the lighting system instead of or in addition to the temporal light coding as applied in the prior art, such as the lighting system known from WO2006/111930A1. A spatial coding is particularly suitable for wallwasher light sources, and thus especially assists personnel in commissioning wallwasher light sources of a lighting system. During commissioning of light sources, the lighting system sets the light sources to create a light pattern on a wall, which may be captured with a light pattern capturing device used by a user to commission light sources and decoded in order to obtain information on the light sources, such as position, sequence, spacing or address, of the light sources in the lighting system. Thus, an easy commissioning may be provided, which does not require the personnel to manually enter sequences of addresses of light sources in a light system controller of the lighting system.

An embodiment of the invention provides a system for controlling a lighting system with a plurality of light sources comprising

- a light system controller for controlling the light sources in that a spatial light pattern is created, which codes one or more attributes of the light sources,
- a light pattern capturing device for capturing the created spatial light pattern and communicating with the light system controller in order to enable the controlling of the light sources based on the captured spatial light pattern.

A spatial light code may be for example a bar code kind light pattern projected on a wall and coding attributes of the projecting light source, such as a unique designator of the light source in a networked lighting system.

The light system controller may be further adapted to control the light sources by transmitting a control code to the light sources in order to set up the light sources to create the spatial light pattern. The control code may be for example either adapted to switch the light sources in a spatial pattern mode, in which each light source creates a spatial light pattern coding attributes of the respective light source, or it may be adapted to comprise a sequence of commands, which control the light sources to create spatial light patterns, coding information.

The light system controller may be further adapted to create the spatial light pattern in that a unique identifier of each of the light sources is coded. A unique identifier may be for example a unique address, for example a MAC address of a light source, or a unique identifier within a special (limited) installation. Typically, in a networked lighting system a unique address is assigned to each light source in order to allow addressing each light source with a light system controller. This address may be coded in the spatial light pattern, for example via known spatial coding schemes such as by using barcodes.

In a further embodiment of the invention,

- a processing of the captured spatial light pattern may be provided and the processing of the captured spatial light pattern may comprise decoding the unique identifiers of each of the light sources and
- the communicating with the light system controller may comprise transmitting the decoded unique identifiers from the light pattern capturing device to the light system controller.

The light system controller may be further adapted to control the light sources to create temporal changing spatial light patterns in that during a predetermined period of time, different spatial light patterns are created. By combining the spatial with a temporal coding, more information may be coded. Particularly, the temporal changing of spatial light patterns makes it possible to also detect a relative position of a light source with respect to other neighbored light sources. The controlling may be performed by transmitting a control code according to the DMX (Digital Multiplex) protocol as it is typically used for controlling dimmer, intelligent spotlights and light effect controllers as typically used in stage lighting.

According to a further embodiment of the invention, the capturing of the created spatial light pattern may comprise scanning the created spatial light patterns during the predetermined period of time and a processing of the captured spatial light patterns may comprise detecting the pointing position of the light pattern capturing device by analyzing the scanned spatial light patterns in that differences between consecutive spatial light patterns are processed for detecting the pointing position. The processing of differences between consecutive spatial light patterns allow to detect the direction of temporal changing light pattern, i.e. in which direction the spatial light patter moves, thus allowing to detect at least a relative pointing position of the light pattern capturing device.

In a further embodiment of the invention, the following may be provided:

selecting of a number of pointing positions of the light pattern capturing device for adjusting the light effect at these locations, and calculating of interpolated light setting parameters for the light sources located between the selected pointing positions. The commissioning according to the invention thus may create a basis to do a proper interpolation in a commissioned sequence of light sources. Spacing of light sources may also go into the calculation and would be available, particularly if commissioned with a waiving method, i.e. when a user waives the device over spatial light patterns.

The communicating with the light system controller may comprise transmitting a user command instructing the light system controller to commission the light sources in the lighting system based on the captured spatial and/or temporal light pattern.

The communicating with the light system controller may also comprise transmitting a user command instructing the light system controller to create a desired lighting scene with the light sources in the lighting system based on the captured spatial and/or temporal light pattern and user inputs.

The invention relates in a further embodiment to a light source being adapted for application with a system according to the invention and as described above and comprising a light pattern generator, which creates a spatial and/or temporal light pattern, which codes attributes of the light source, upon receipt of a control code from a light system controller.

The light pattern generator may be further adapted to code the address of the light source in the created spatial pattern.

Another embodiment of the invention provides a light pattern capturing device being adapted for application with a system according to the invention and as described above and comprising a spatial light pattern capturing unit being adapted to capture a spatial light pattern created by one or more light sources, a light pattern processing and decoding unit being adapted to decode attributes of the light sources decoded in the captured light pattern, and a communication unit being adapted to communicate decoded attributes to a light system controller for controlling the light sources, to which the received attributes relate. The invention also provides the possibility to communicate the captured signal and to process the signal at a different location, for example in the light system controller. In such a case, the capturing device may comprise only a photodetector, signal conditioning electronics and a transmitter. At a different place (where the required processing power is available), the signal may be received and processed.

A further embodiment of the invention provides a method for controlling a lighting system with a plurality of light sources comprising the acts of controlling the light sources in order to set up the light sources to create a spatial light pattern, which codes one or more attributes of the light sources, capturing the created spatial light pattern and controlling the light sources based on the processed spatial light pattern.

According to a further embodiment of the invention, a computer program may be provided, which enables a processor to carry out the above method according to the invention.

According to a further embodiment of the invention, a record carrier storing a computer program according to the invention may be provided, for example a CD-ROM, a DVD, a memory card, a diskette, internet memory device or a similar data carrier suitable to store the computer program for optical or electronic access.

A further embodiment of the invention provides a computer programmed to perform a method according to the invention such as a PC (Personal Computer), which may comprise an interface for a light pattern capturing device and for communication with light sources for controlling the light sources.

These and other aspects of the invention will be apparent from and elucidated with reference to the embodiments described hereinafter.

The invention will be described in more detail hereinafter with reference to exemplary embodiments. However, the invention is not limited to these exemplary embodiments.

BRIEF DESCRIPTION OF THE DRAWINGS

FIG. 2 shows a table with an example for 5 bits of identifiers hidden in a barcode generated by 16 channel lamp;

FIG. 3 shows a table with an example for 32 bits of information hidden in a color barcode generated by 16 channel RGB lamp;

DETAILED DESCRIPTION OF EMBODIMENTS

Figure 1:
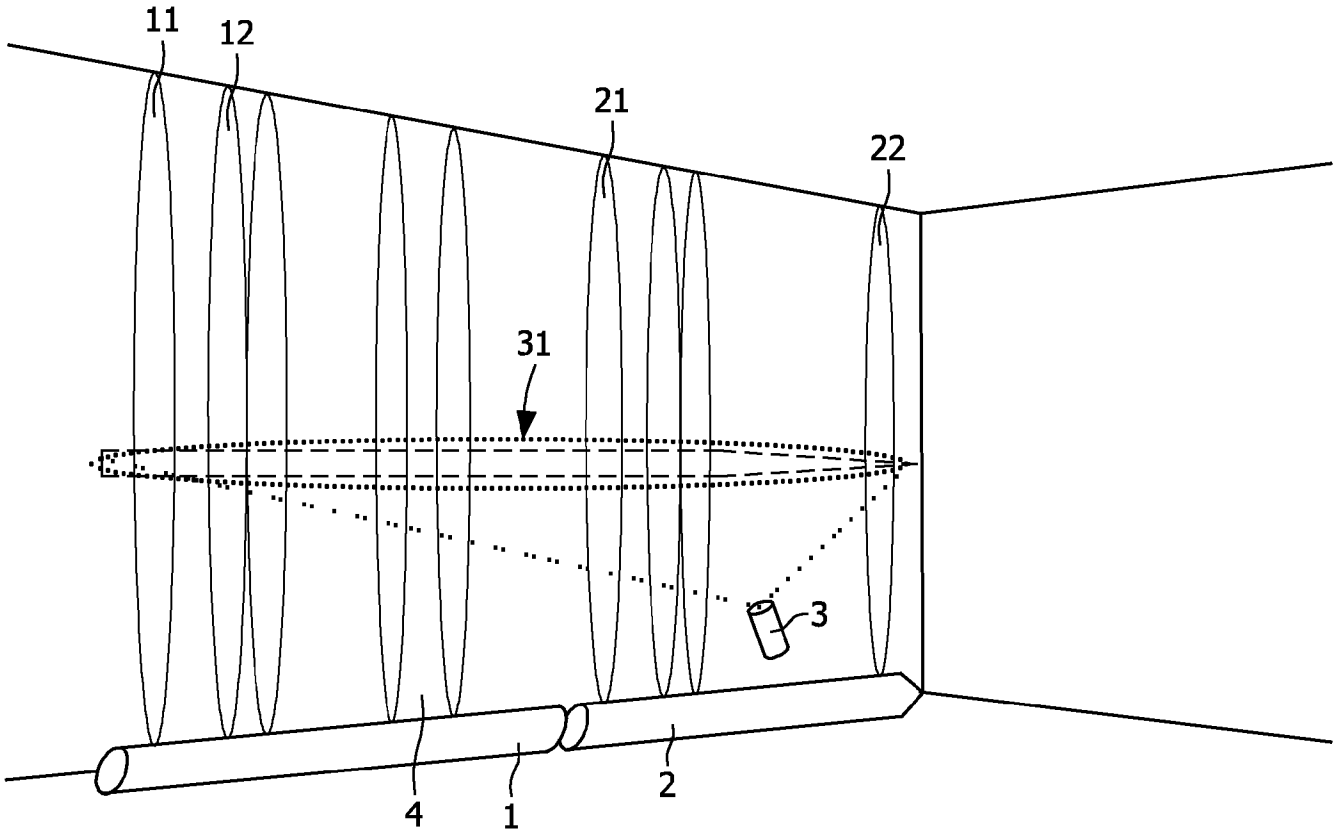
FIG. 1 shows an embodiment of a lighting system comprising two wall washers projecting a spatial light pattern on a wall and a light pattern capturing device for capturing the spatial light pattern according to the invention.

In the following, functionally similar or identical elements may have the same reference numerals. Also, in the following description, the term "lamp", "luminaire" and "light source" are used as synonyms, each meaning the same and describing any kind of controllable light source which can be used in lighting systems with a plurality of light sources.

In the following, the invention is explained by means of exemplary embodiments. The described embodiments are an alternative to coded light generated by a light source, i.e. to temporal coding or frequency coding of light, and are particularly suitable for easy commissioning of wallwasher light sources and other kind of light sources mounted in sequence, such as for example downlighters along a main way in a shop. In contrast to the temporal light coding, the invention uses spatial codes or spatial light patterns, which code information. Commissioning light sources can be done with a light pattern capturing device, which may be implemented as an optical hand-piece that is able to read that spatial code. In the following, two embodiments of the light pattern capturing device will be described: a self scanning reader, and a reader, which is slid along the wall with the coded effects. The wall washer lamps "communicate" in some way with the user interface tool used for commissioning.

FIG. 1 shows two wall washers or wallwash lamps 1 and 2 arranged for illuminating a wall 4 of a room. The wallwash lamps 1 and 2 are controlled by a light system controller (not shown in FIG. 1). The light system controller may transmit control codes to the wallwash lamps via a wired or wireless connection, for example a ZigBee™ wireless communication connection. The wallwash lamps 1 and 2 are adapted to process the received control code. Each wallwash lamp 1 and 2 may comprise a predefined set of control codes, with which certain functions of the lamps may be initiated. One control code may set the wallwash lamps 1 and 2 to create a spatial light pattern on the wall. The spatial light pattern contains a sequence of the intensities (or colors) which is selected in a way to allow identification of the light source, which creates the sequence. The spatial light pattern 11, 12, 21, 22 on the wall 4 generated by the light sources 1 and 2 is similar to a barcode. This barcode codes unique addresses of the wallwash lamps 1 and 2 such as a MAC address, programmed in the wallwash lamps 1 and 2 or might be used to code parts of these addresses.

A light pattern capturing device 3, which serves as a commissioning tool, comprises some optical system that projects the spatial light pattern as visible on the wall in an area 31 or parts of this area into the device. Area 31 is the capturing area of the device 3, i.e. the area which is projected to the optical detector or the scanning range of an automated scanner implemented in the device 3. The device 3 can be a camera or a mechanical scanner that directly reads the different intensities (colors) e.g. from left to right. Codes of the light effects visible in this area 31 are captured with the device and processed in that captured codes get automatically decoded in the device 3. The device 3 is adapted to communicate with the light system controller of the lighting system, as will be described later in more detail.

For commissioning of for example all lamps of a lighting system, the light codes decoded by the device 3 may be sent from the device 3 during commissioning process and may contain access information for the lamps. For the commissioning, all wallwash lamps of a lighting system may be switched on to show their individual identifier. This may be for example initiated by means of a special control command code that gets broadcasted to all lamps from the light system controller.

The codes in the spatial light patterns that are shown on the wall are formed such that they are easily readable to keep effort in hand piece as well as aiming and detection accuracy during reading low. The generated spatial light patterns or codes may be for example similar to uni-dimensional barcodes, since such codes may be easily scanned with a barcode scanner, especially adapted for capturing the spatial light patterns according to the invention.

Some of the following requirements can make the capturing of a spatial light pattern easier: a code or spatial light pattern should be readable even when a lamp is mounted in reverse direction so a clear start coding is required. A code should be readable even when the viewpoint is not perpendicular to the center of the code on the wall, so it should be rugged for optical distortion.

As already mentioned above, coding schemes as are used for barcodes in many applications can solve both of the before mentioned requirements and are very well applicable here.

In the following, two coding schemes are described for completeness and also to make the coding as well as the reading more clear.

FIG. 2 shows exemplarily in a table the coding with a spatial light pattern, created with a wallwash lamp with 16 channels S0 . . . S15. Each channel of the lamp may code one bit of digital information. Valuable information or lamp attributes placed in the bits coded in the spatial light pattern may be for example the address of the lamp, and probably type of lamp. Other attributes may also be coded such as certain functionality of the lamp like available light effects. The data bits may be transmitted from a light system controller to the wallwash lamp. The generated spatial light pattern can be determined by the light system controller, so that the wallwash lamp simply generates the spatial light pattern as determined by the light system controller.

In the table of FIG. 2, the most left 6 channels of the lamp with bits S0 . . . S5 show always a code with a bit sequence "101110". This code allows for a clear lamp framing because the coding scheme provides that three consecutive bits "1" (channels S2, S3, S4) should never occur within a normal data field of a selected code of a spatial light pattern. The first sequence of the bits "1"-"0" (channels S0 and S1) can be used to adjust the bit rate while the scanner of the light pattern capturing device runs over the pattern. Channel S5 is used as gap between the framing bits and the information bits coded with the channels S6 . . . S15. The 10 following channels S6 . . . S15 are grouped in 5 pairs 0L, 0H, 1L, 1H, 2L, 2H, 3L, 3H, 4L, 4H, where the first channel from left 0L is set to on if the related data bit is "0" and the right channel 0H if the data bit is "1". This guarantees for regular changes in the intensity allowing keeping bit synchronism. In big installations, this code may still produce aliases when read in reverse. However, after taking the complete code in with light pattern capturing device, the tree consecutive "1" S2, S3, S4 set clearly were the code starts.

As many lamps used for wall washing allow for dimming and have multiple colors per channel available, other more sophisticated coding schemes can be employed. In the following, one possible embodiment of a color assisted coding scheme is described with regard to FIG. 3, which shows in a table the coding with a spatial light pattern, created with a wallwash color RGB lamp with 16 channels. A coding with this kind of lamp may be achieved with a simple timing when the red channel (with the exception of the three most left channels, which are set to "1") always changes state from bit frame to the next, i.e. channels 4, 6, 8, 10, 12, 14, and 16 are set to "0" while the channels 3, 5, 7, 9, 11, 13, and 15 are set to "1". The two other channels, the green and blue channel, also allow to code information, thus allowing coding more information or more bits in total in contrast to a single color lamp, such as explained with regard to FIG. 2. Observing all three colors and clocking the intensity values of these colors in with the light pattern capturing device allows directly reading of the information coded in the generated spatial light pattern.

A commissioning process may be performed as follows: A commissioning person makes a waving movement with the light pattern capturing device or commissioning tool sliding e.g. from the left edge of the spatial light pattern generated from the most left wallwash luminaire to the right edge of the most right wallwasher. The tool records the sequence of the "seen" light codes on the wall during this slide. The recorded sequence of the "seen" light codes may then be analyzed by the tool. Analyzing may also be done on the light system controller. The result of an analysis of the recorded sequence of "seen" light codes or the recorded sequence of "seen" light codes gets then transferred to light system controller which can determine from the light codes the addresses of the different lamps. In addition the time sequence of the "seen" light codes can be used to determine spacing of the lamps (e.g. when multichannel wallwashers have been mounted with a certain distance to each other). This information is valuable for calculation of smooth color interpolation scenes.

Figure 4:
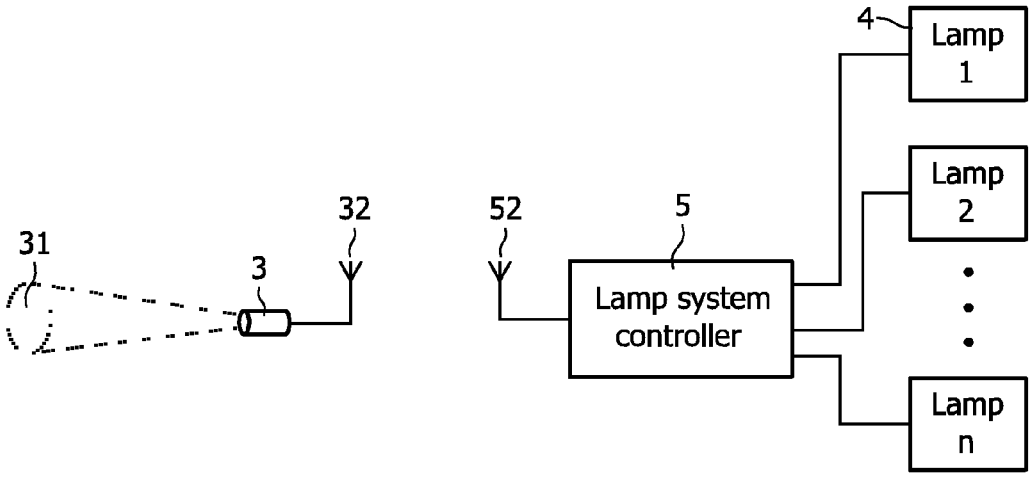
FIG. 4 shows a block diagram of an embodiment of a system for controlling a lighting system according to the invention.
Figure 5:
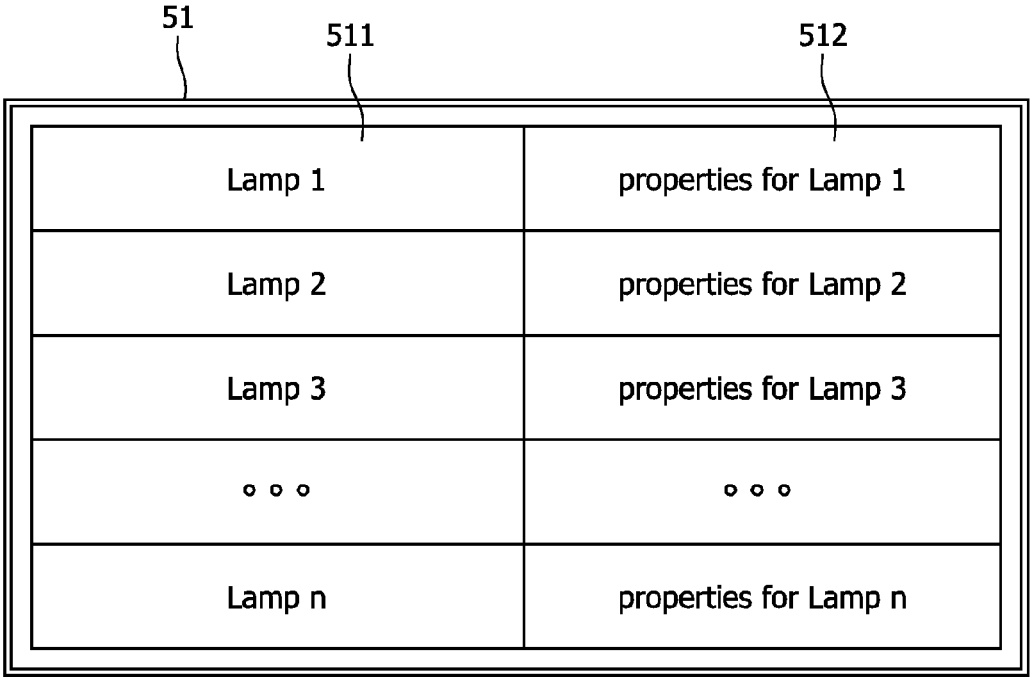
FIG. 5 shows an embodiment of data structures in a light system controller according to the invention.

The setup of a lighting system is explained now by means of a block diagram of a lighting system and a system for controlling the lighting system shown in FIG. 4. A light (lamp) system controller 5 has access to the light sources or lamps 1 and has a link to a handheld device 3 that implements the light pattern capturing device and serves the user as user interface for controlling the commissioning process. The lamp system controller 5 may be for example implemented by a Personal Computer (PC) or an embedded computer, which is configured by software implementing a method for controlling the lighting system according to the invention. The lamp system controller 5 comprises an interface for communicating with the hand held device. The link between the lamp system controller 5 and the hand held device 3 can be realized by means of a radio link. The antennas 32 and 52 may be integrated in handheld device 3 and/or the lamp system controller 5 respectively. The lamp system controller 5 keeps track of the lamp access information and the lamp properties by means of a lamp table 51 as depicted in FIG. 5. The lamp table 51 is stored in a memory of the lamp system controller 5 and comprises a row for each commissioned lamp or light source of the lighting system. Each row comprises two columns, one containing a unique identifier of the lamp in the system, for example the unique address of the lamp, and the other one containing properties of the lamp. In addition to the input 52 shown in FIG. 4, the lamp system controller 5 may also have further control inputs (not shown) to select different scenes or to set up different scenes from a further data source. The lamp system controller 5 is configured to map a commanded lighting scene data to the real lamp installation based on the detected order and direction and even the spacing of lamps. It may be advisable to cover buttons on the device 3 that are only used during commissioning in order to avoid that users accidentally destroy commissioning information as stored in the column 511 of the lamp table 51. The shown system may also be configured to allow entering a commission code only once and need some complete reset to enter it again. (Mapping of "lamp number 2" to "lamp with physical address 0x45" with the property "in reverse direction" still unclear)

Figure 6:
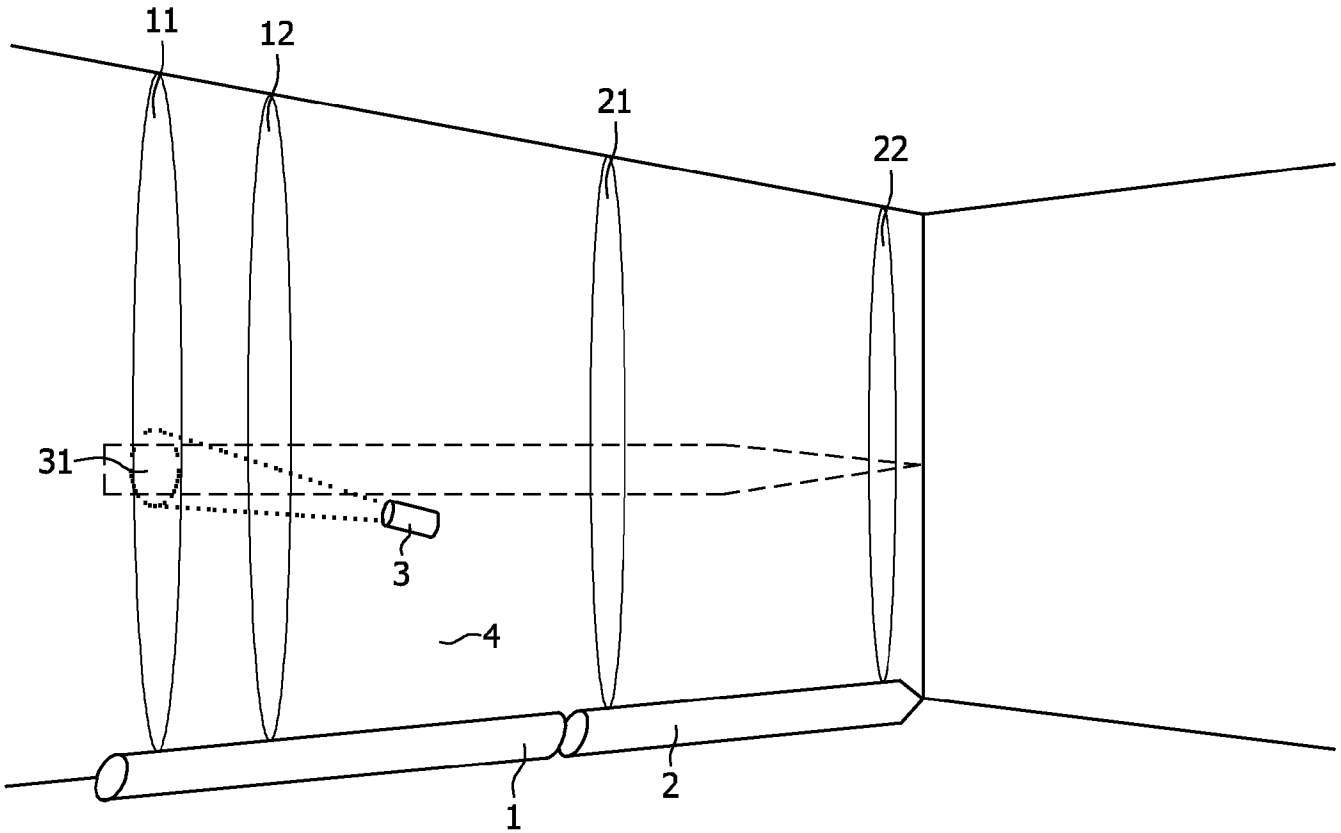
FIG. 6 shows a further embodiment of a lighting system comprising two wall washers projecting a spatial light pattern on a wall and a light pattern capturing device for capturing the spatial light pattern according to the invention.

The user commissions the system by means of the hand held device 3 by initiating a commissioning of lamps of the lighting system by pressing a button on the handheld device 3. The pressing of the button causes the handheld device 3 to generate a control command for commissioning and transmits this command to the lamp system controller 5 via the wireless communication link, established by 32 and 52. Upon receipt of the command, the lamp system controller 5 broadcasts a control code to all light sources of the lighting system in order to set up the light sources to create a spatial light pattern coding attributes of the light sources or lamps 1 and 2. The control code causes each addressed lamp 1 and 2 of the lighting system to generate a spatial light pattern, for example on a wall 4 as shown in FIGS. 1 and 6.

The handheld device 3 has a sensor allowing focusing on a light effect (FIGS. 1 and 6) in a defined sensitive area 31. The defined sensitive area 31 depends on the optical means of the hand held device 3 and may be either completely cover the generated spatial light pattern similar to a photo camera, thus allowing a quick capturing of the spatial light pattern as shown in the embodiment of FIG. 1, or it may cover only a limited spot as shown in the embodiment of FIG. 6, with which the spatial light pattern may be scanned from for example left to right similar to a barcode scanning device. In any of the embodiments of FIGS. 1 and 6, the handheld device 3 captures under control of the user the spatial light pattern projected on the wall 4 by the wallwash lamps 1 and 2. This capturing may be initiated by the user by pressing a single button, that for example activates commissioning and that needs to be pressed before the devices captures the spatial light pattern either in one shot (FIG. 1) or by scanning over the spatial light pattern linearly (FIG. 6; the user may start the scanning process by pressing a button, or the scanning process may be performed while the user presses the button). During the capturing process, the handheld device 3 records the sequence of the "seen" light codes on the wall.

The captured spatial light pattern is then processed in the handheld device 3 by decoding all attributes or properties of the wallwash lamps 1 and 2, particularly their (unique) addresses in the lighting system and their lamp type. The decoded attributes or properties are then transmitted from the handheld device 3 to the lamp system controller 5 via the wireless communication link 32 and 52 (FIG. 4).

After receipt of the transmitted attributes or properties, the lamp system controller 5 generates the table 51 of the commissioned lamps 1 and 2 that is starting from the first lamp selected to the last selected lamp as depicted in FIG. 4. The table 51 contains in column 511 the addresses to access the lamp and in column 512 the property that (gets assigned) to that lamp, particularly the lamp type. Alternatively also properties detected from each lamp 1 and 2 can be stored in the table 51 supporting for example lighting scene setting interpolations. During normal operation of the lighting system, light sources will show the lighting scene that a user has programmed. So during normal operation the identification of lamps as described above is usually not possible, but can be made possible in principle. As already mentioned above, the hand held device could be also comprise a camera or a mechanical scanner to get the light effects in a sequence in order to decode the spatially buried information in the light pattern, In the embodiments described above, the technology of spatially coded light can be integrated in a setup protocol for wallwash applications. However the described user interaction is not limited to wallwashing but allows also commissioning and control for other types of linesources that are linearly arranged.

Although embodiments of the invention were described above for commissioning light sources or lamps of a lighting system, the invention is not restricted to only be applicable for commissioning, but can also applied for setting of lighting scenes in a complex lighting system or for operating a lighting system. Generally speaking, the invention is applicable to control a lighting system, wherein control comprises any kind of operation of a lighting system.

Figure 7A:
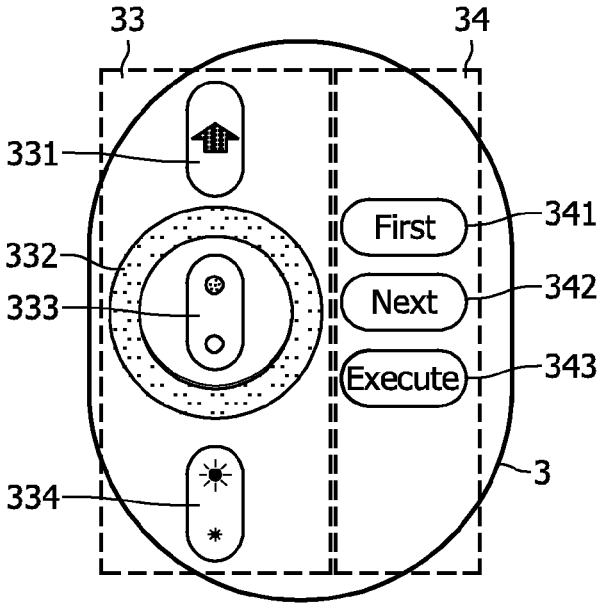
FIG. 7A shows an embodiment of a light pattern capturing device according to the invention
Figure 7B:
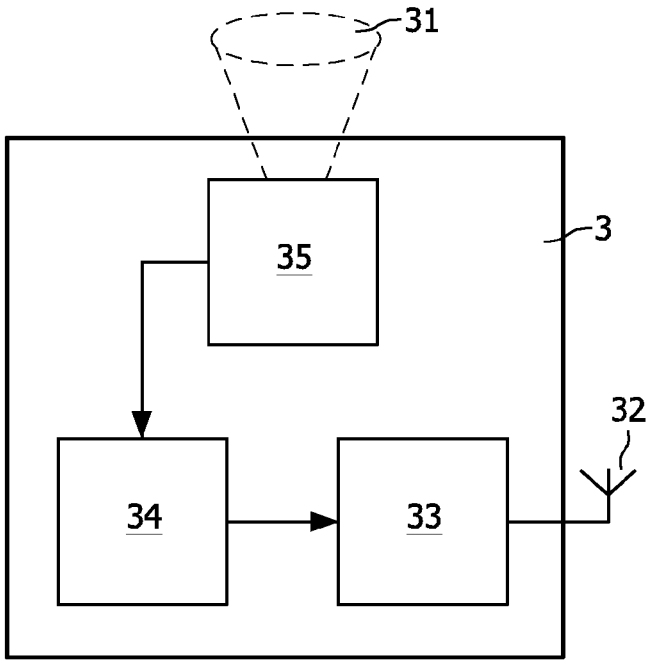
FIG. 7B shows a block diagram of an embodiment of a light capturing device according to invention.

Embodiments of the handheld device 3 according to the invention are shown in FIGS. 7A and 7B. The handheld device 3 shown in FIG. 7A comprises a number of buttons for interaction with the user. There are two groups of buttons. The group 33 comprises a "select" button 331 and adjust buttons for color 332, saturation 333 and or brightness 334. The sequence section 34 contains button "first" 341 to start a new scene setting or to start commissioning, In addition "next" button 342 and button "execute" 343 are used to end commissioning or scene setting. FIG. 7B shows a block diagram of an embodiment of the handheld device. The device 3 comprises a light pattern capturing unit 35 which is able to capture a light pattern in the capturing area 32. The unit 35 may be for example a CCD- or CMOS-sensor as implemented in digital photocameras, a photodiode with an optics, or a mechanical scanning device, which scans over the area 31, or a barcode scanning unit, which is able to detect light. The device 3 further comprises a light pattern processing and decoding unit 34, for example a microcontroller, which is configured to process the digital output signals of the unit 35 and to decode attributes of the light sources decoded in the captured light pattern. The microcontroller may for example execute a software, stored in an internal memory of the controller, which implements an image processing procedure, especially adapted to decode spatial light patterns, for example to decode barcode-like spatial light patterns. Furthermore, the device 3 comprises a communication unit 32, for example a wireless signal transmitter, which is able to initiate a communication link with a light system controller and to transmit digital data over the link to the light system controller, particularly any decoded values such as decoded attributes like the addresses of light sources.

Now the interaction of a user with the handheld device 3 in a commissioning mode of the system shown in FIG. 4 is described in detail with regard to the situations shown FIGS. 1 and 6. The device 3 has a start button "first" 341 that the user presses when she/he starts at the left edge of a spatial light pattern 11, 12, 21, 22 projected on a wall 4 with the wallwash lamps 1 and 2 as shown in FIGS. 1 and 6. For each subsequent lamp the user presses the "select" button 331. The device 3 starts decoding the "seen" codes per click and stores these in the sequence of new codes in the vision field 31 of the device 3 into the memory until the user presses a button stopping the sequence. This can be button "execute" 343 to end commissioning. If the lamps are ordered in a matrix rather than a single line user can press "next" button 342 to start with the next row of lamps again from left.

In an improved embodiment, the user does not have to press for every lamp the "select" button 331. However after pressing button "first" 341 the user waves the device 3 from the first to the last spatial light pattern she/he wants to commission in a row. When e.g. the first lamp is the most left lamp of a wallwash installation the user waves to the right and the hand held device records all codes and for each new code a new lamp entry is made in the table 51 (FIG. 5) to commissioned lamps. When the user has reached the right edge of the effects button "execute" 343 gets pressed to stop recording. Alternatively button "next" 342 may allow starting with the next row of lamps. The commission is not limited to detect spatial light patterns or light effects in a strait, horizontal line. In case a wall is illuminated in the top, the middle and the bottom zone and each zone has several light effects, the user might also wave diagonal or in a curved line across the wall. Then, this path will be stored and a light distribution (e.g. a transition from dark to bright) can be assigned to this path. As a result of this commissioning procedure, the table 51 of commissioned lamps is generated that is starting from first lamp selected to the last selected lamp as depicted in FIG. 5.

Next, the interaction of the user with the handheld device 3 in a scene setting mode of the system shown in FIG. 4 is described in detail with regard to the situations shown FIGS. 1 and 6.

During the scene setting mode again all lamps are on and are modulated to send their codes via spatial light patterns constantly. To set a desired lighting scene, the user selects a certain spatial light pattern of a lamp by pointing to the pattern and pressing "select" button 331. The tool starts decoding the "seen" code when the user now changes the color 332, saturation 333 and or brightness 334 by pressing the related buttons in region 33. Thus, the properties of the selected lamp will be set. To give the user an impression how that effect looks like the addressed lamp may be also programmed with these properties directly. This allows for interactive property selection. During this the addressed lamp may change also into a mode where it is not emitting any codes because it was already addressed. If the user wants to set more properties she/he points to a next effect and issues the "select" button 331. This can be done multiple times. To finish, the user presses the button "execute" 343. Now the properties of all lamps where the user had not pointed to get calculated to interpolated values in order to produce soft changes in the row of effect.

For lamps with multiple channels detection of the channel pointed to can be detected by means of temporal codes or a fine granularity special code to allow for accessing a single channel for adjustment of the light properties.

For an example in a system with lamps 1 to 16 commissioned in a single row the user may press red on lamp 3 and yellow on lamp 12. The system will assign red to lamps 1 to 3 and yellow to lamps 12 to 16 and a variation going over orange at lamp 8 for all lamps in-between. In this way a complex 16 light sources scene can be set automatically by adjusting only 2 values.

In a second embodiment, it is assumed that an existing scene (e.g. a color gradient) is shown on the wall wash area. The task is to modify that scene. One reason to do this might be that a bright white light effect is desired behind an object placed in front of the illuminated area.

Now, the handheld device 3 is directed towards the desired location and the "Select-Button" 331 is pressed. Codes in form of spatial light patterns are superimposed with the existing scene. In case there is sufficient light present at the location where the user is pointing to, the device 3 will detect the codes and will be able to determine the position. In case after some time, the tool has not recognized the codes, a special light effect (e.g. a chasing light or the sequence used during commissioning) may be used to "find" the position.

In another embodiment of the system the device 3 may also contain buttons to select the interpolation mode. This may allow selecting whether interpolation is only using HUE value interpolation or whether the interpolation goes over low saturation or low brightness as it can be advisable for going from red to blue without having violet in-between. Also buttons to control more in the white may be included to have e.g. neutral, cold, warm white. Or provisions for numeric dim value or color point setting.

Finally, the interaction of the user with the handheld device 3 in an operation mode of the system shown in FIG. 4 is described in detail with regard to the situations shown FIGS. 1 and 6.

During normal operation light sources may stop emitting spatial light patterns. When user starts operating the handheld device 3 the lamp system controller 5 may again go automatically in one of the interactive modes. Touch sensitive sensor integrated with the handheld device 3 or a tilt or movement sensor may activate sending codes.

Next, an embodiment of the invention is described in detail, which allows detecting the position of a light effect in a DMX (Digital Multiplex) installation of a lighting system by generating a temporal changing spatial light pattern. It should be noted that the embodiment is described based on a DMX data stream because an available demonstrator to prove the feasibility of this embodiment is based on existing DMX components. On the other hand, the embodiment is not limited to DMX but can also be used with other control interfaces, such as 1-10V.

The embodiment described in the following provides a simple DMX data stream manipulation and detection algorithm to calculate the position where the handheld device 3 is pointed to. One advantage of the embodiment is that it can be used as an add-on to existing remotely controllable lamps. In addition, the signal generation and analysis is less complex and hence less expensive than other more costly provisions for detecting the pointing position of the handheld device 3.

The embodiment described herein requires the lamp system controller 5 of FIG. 4 to be able to generate a special luminaire control signal, i.e. a suitable DMX command, and the handheld device 3 to be able to capture the resulting light effect, particularly a spatial light pattern by means of a photodiode with collimating optics, integrated in the handheld device 3. The position within the light effects of a luminaire may then be recalculated by analyzing the photodiode signal. Thus, by simple pointing to a desired location along a predetermined path the system can detect the position the user is pointing to. This position information can be used to "learn" the positions of the light effect and to assign light effects to the selected location. Furthermore, this can be done without changing the existing luminaire. The whole functionality can be realized via the DMX bus, hence it can be used with existing luminaries. No wired or wireless synchronization between a signal generator and a detector is required. All this is included in the resulting light effect based on the generated DMX-sequence.

In addition to the above described spatial pattern, the solution in this embodiment allows to detect the individual light effect within the luminaire the user is pointing to, rather than only identifying the complete multichannel luminaire based on the emitted pattern. The DMX-sequence may be combined with the barcode patterns described before, e.g. use the barcode during commissioning and use the DMX-Sequence during scene editing.

The luminaries suitable for the methods and use-case described in the following are wall washers, such as the ColorBlaze72™ from the Applicant. These luminaries offer a total of 36 controllable channels, arranged in 12 groups of RGB. When aligning the light effect along a wall, 12 color controllable "fingers" or stripes light pattern can be produced. The control interface for the luminaire is a DMX interface. There are usually several luminaries connected to a DMX-bus (called a "universe"), wherein the serial send data are interpreted by the lamps based on the addresses they have. The user can select the base address (e.g. via switches or via up/down-keys and a display). For example, in case a ColorBlaze72™ luminaire is set to address 23, the data bytes 23 to 58 (=23+35) are interpreted as control signals for this luminaire.

In the embodiment, the luminaire is set to address 1 only one luminaire is connected to the each of the control outputs of the light system controller 5, which is configured to generate a repetitive DMX-Stream for each control output. Instead of the light system controller, a special device for generating the repetitive DMX-stream could be used. A second special device might be used to generate the signals for a second luminaire. During normal operation, there should be no negative influence from the add-on special device. For example, in case the system or the selected lamp is not in a mode where the detection of the light effects with the handheld device 3 is required, the original data describing the light effect is sent to the lamp.

Figure 8:
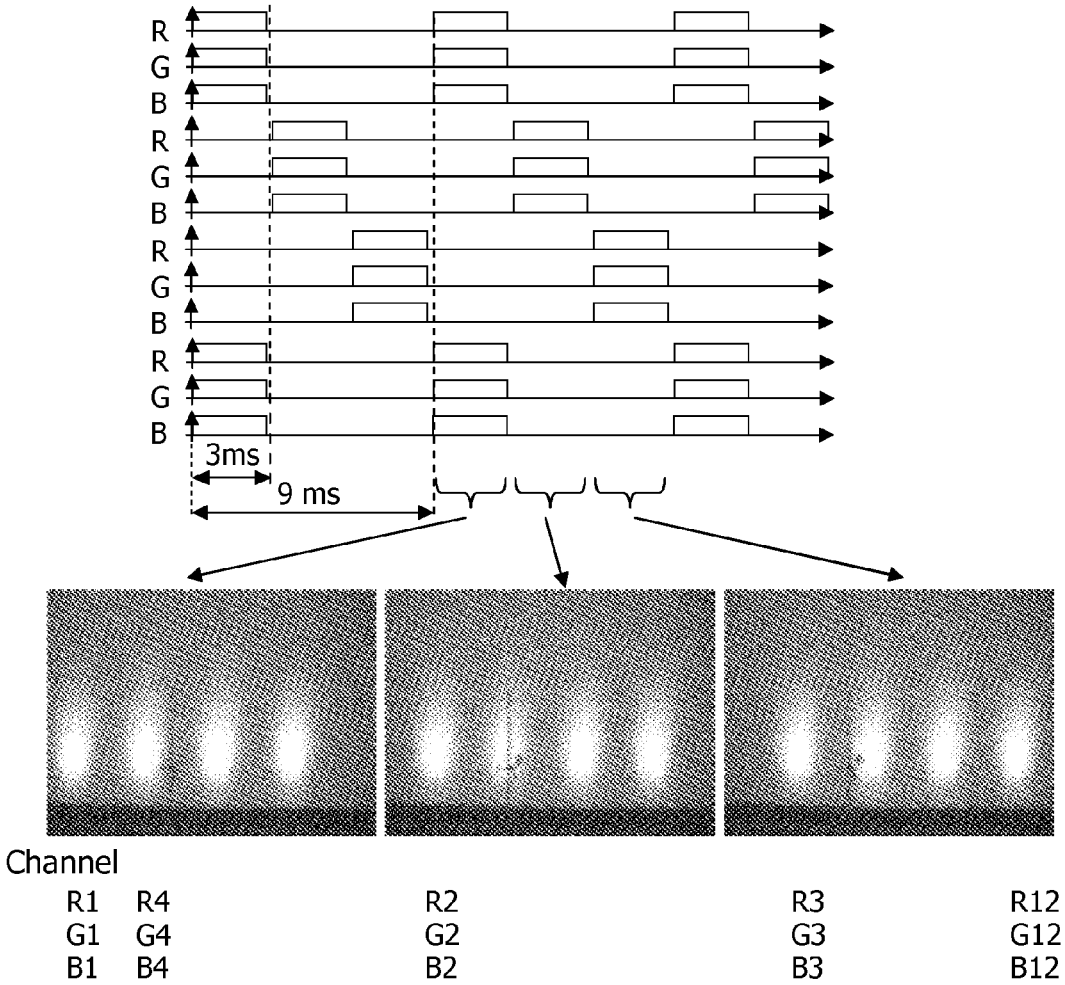
FIG. 8 shows an example of a control value sequence for controlling a wall washer according to the invention and the respective temporal changing spatial and temporal light pattern created by the wall washer due to the sequence.

The DMX-stream, generated when the detection of the light effect with the handheld device 3 is required, is made up in a sequence of three steps: In step or timeslot 1, the pixels 1, 4, 7, 10 of the luminaire are set to max intensity, the rest is off In step or timeslot 2, the pixels 2, 5, 8, 11 are set to max intensity, the rest is off Finally, in step or timeslot 3, the pixels 3, 6, 9, 12 are set to max intensity, the rest is off. FIG. 8 shows this sequence and the resulting optical effect, i.e. the generated three different and repetitive spatial light patterns produced by the wall washer due to the DMX-stream. In this example, the repetition time is 9 milliseconds, hence the resulting effect is a wall washer which is set to 33% intensity on all pixels, because the human eye is to slow to see this 9 milliseconds-repetition of the different spatial light patterns. In the other hand, a photodiode- or a photo camera with an exposure time below 3 ms, as used to take the pictures for FIG. 8, is fast enough to capture this.

For detection of the position, the focus spot of the photodiode should be moved from "outside" into the light effect area of the wall washer. Here, the user may chose a path either from left or from right into the light effect area. The analyzing system continuously searches for characteristic pulses (3 milliseconds wide in our example). The pulsation is present in the light effect, hence no additional synchronization between the DMX-sequence generating device and the detector with the photodiode is required. Based on the pulses and on a "history", the position can be detected, as will be described now.

Figure 9:
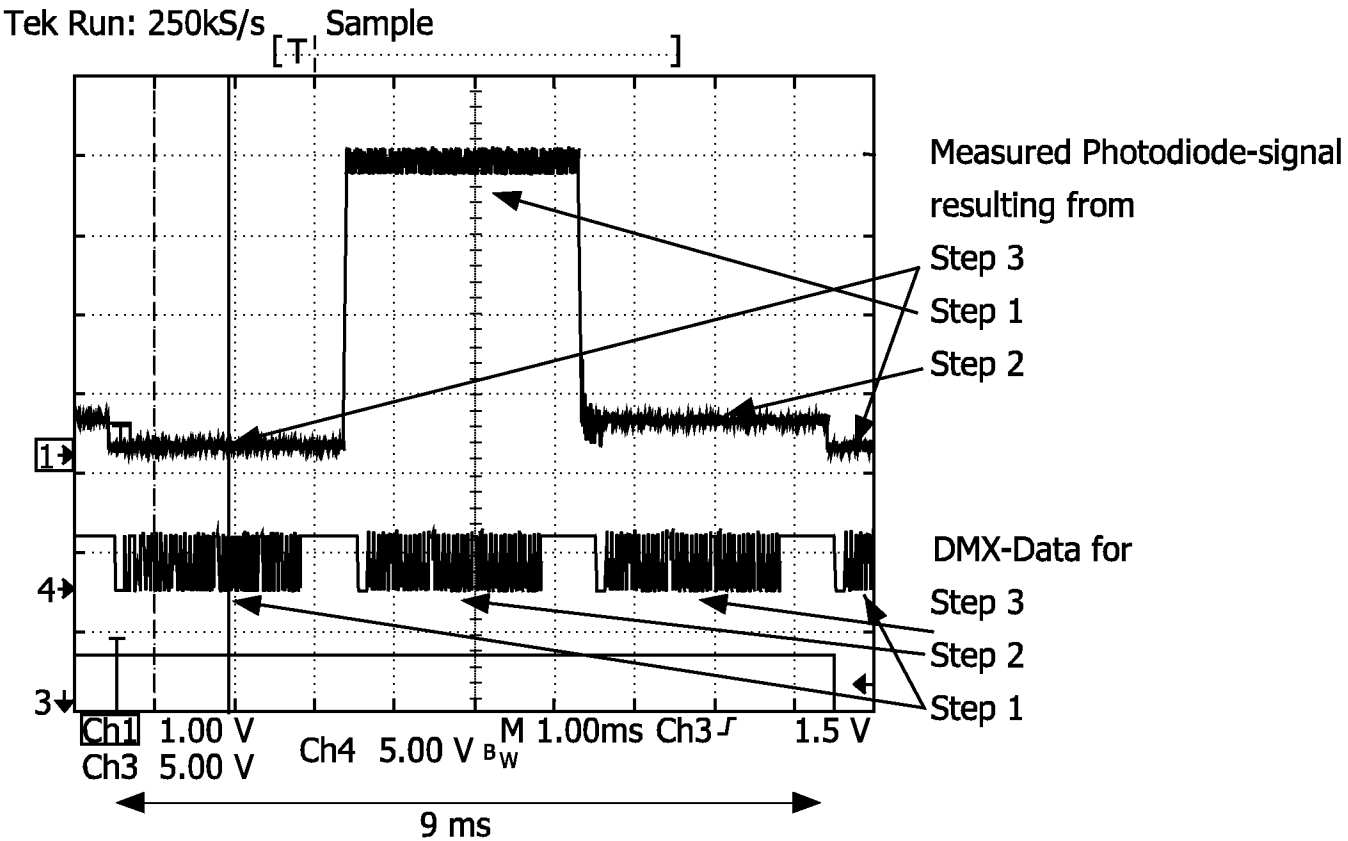
FIG. 9 shows the acquired photodiode signal (top) resulting from the temporal changing spatial light pattern and a DMX-data stream (bottom) to generate the temporal changing spatial light pattern.

When moving the photodiode's sensitivity spot, the light effect areas of the different pixels are focused and captured one after the other. Initially, i.e. after the first occurrence of a pulse, no information on the position is known. But a soon as the focus is moved to the next pixel position, the system notices that the peak signal occurrence is moved from one timeslot to another timeslot. If, for example the focus is moved from left to right, the first signal might be similar to the trace in FIG. 9, which shows an exemplary measurement trace of the photodiode signal caused by the temporal changing spatial light pattern generated from the luminaire due to the DMX-sequence, which is also shown in FIG. 9 at the bottom of the measurement diagram. When changing the focus position, the captured signal will change. This change over time carries some information on the position the user is pointing to. In case the measured signal during step 2 increases while the signal during step 1 decreases, the focus has to have moved toward the right side, hence the initial position was on pixel 1 and after the first move, the pointing position of the handheld device 3 is towards pixel 2. In case the user would choose a path from right to left, the signal during step 3 (before the initial detected pulse) would become an increased value. Then, the systems knows that the initial position was on pixel 12 and the position after the first move is towards pixel 11. After this initial detection of the entrance position, the further positioning can be tracked easily, just by evaluating in which timeslot the measurement is increasing or decreasing. Since this is a relative positioning inside the visible light effect, the handheld device 3 needs no timing information from the controller 5. Especially, it is not required to know whether a certain measured signal results from a command during step 1 2 or 3.

Figure 10:
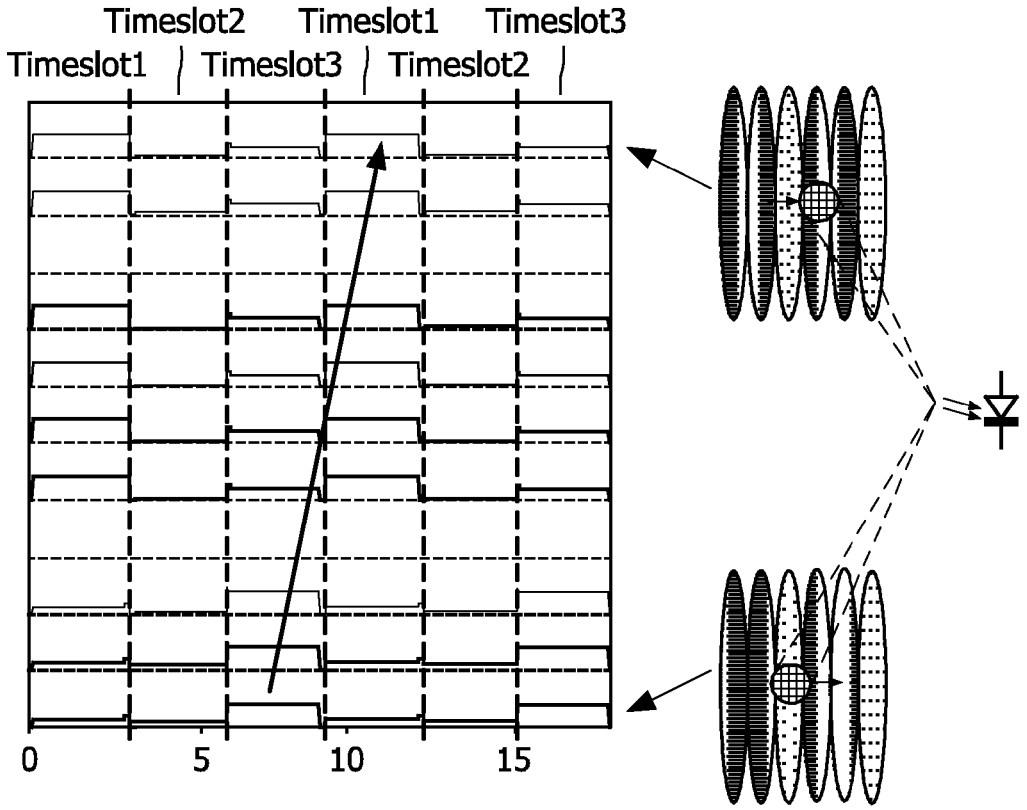
FIG. 10 shows an embodiment of simulated signals when moving the focus of the light pattern capturing device towards the right for scanning the temporal changing spatial light pattern according to the invention.

In FIG. 10, a simulation result of the essential signals, when the focus of the handheld device 3 moves towards the right, is shown. In the left part of the figure, the captured signal form the photodiode is shown as several points in time. The lowest trace is the initial situation, at t=t0. The traces above are for increasing time, t>t0. The right part of the figure depicts the position of the focus of the detector within (a part of) the light effect generated by the luminaire. The lower part is the initial position, relating to the lowest trace in the left part of the figure, the upper part is the final position relating to the uppermost trace in the left part. The arrows in FIG. 10 represent both the moving direction of the focus position and the advancing time. As can be seen, the signal in timeslot 3 decreases while timeslot 1 increases. The lowest trace of the shown simulation result is the initial position. Then, the height of the following pulse is increasing while the initial pulse is decreasing. At the upmost trace, the focus is on the next pixel position.

Figure 11:
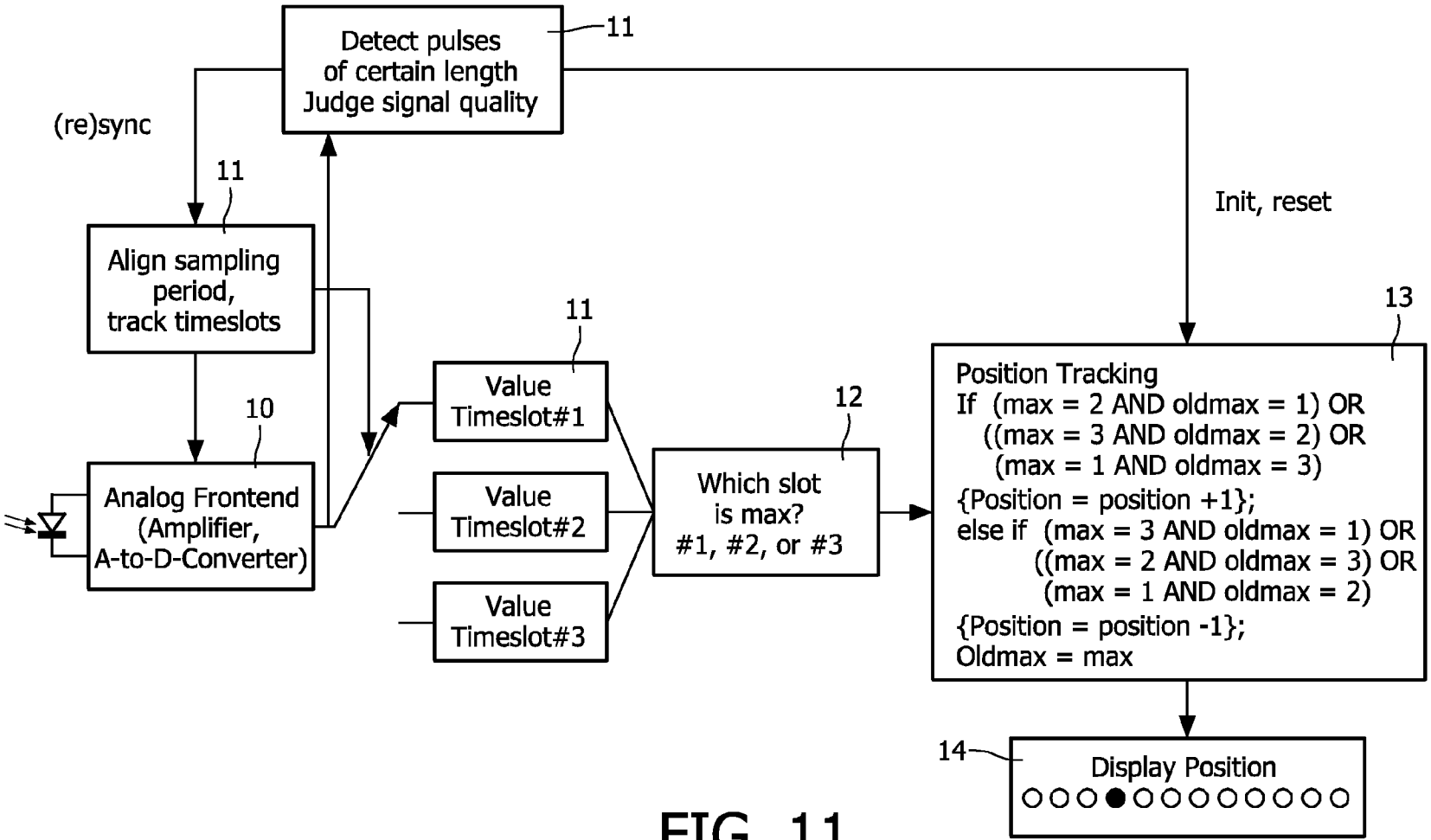
FIG. 11 shows the signal analysis process in a system for controlling a lighting system as it is performed when a temporal changing spatial light pattern is analyzed according to the invention.

The signal analysis workflow of this embodiment is briefly depicted in FIG. 11. Several tasks are running in parallel. One task 10 is to sample the analog input signal. The second task 11 is to detect pulses within the stream of sampling values to (re)-synchronize the sampling and to select the relevant samples for the three timeslots. Then, in a following task 12 the timeslot signals are evaluated. Depending on the decision in which timeslot the max signal is found, the position is tracked in task 13. Lastly, the found position may be displayed in task 14. The second 11 task is also responsible for initialization of the position tracking loop. Alternatively to displaying the detected position in task 14, the detected position may be communicated to the controller 5, preferably via a wireless communication link. The controller 5 may modify the DMX-sequence based in the detected position, e.g. to provide a feedback on the detected position. This may be superimposed with the 3-step signal. In the example above, the pixels were set to maximum intensity. It is possible to select a different value and then increase the brightness at the detected position. The used will the see a brighter spot at the position she/he is pointing to. All user interaction (select a position, set a color . . . ) described for the other embodiments described before can be combined with this detection method.

Briefly summarized, the present invention particularly relates to the following: a lamp system comprising lamps, a system controller and a handheld device to allow semi automatic lamp commissioning and scene control, wherein light patterns are used to identify lamps and their relative position. The lamp system may make use of a handheld device containing an optical sensor that "sees" a defined area and can be pointed and scanned over a sequence of light effects to be commissioned. A hand held device may scan an area (e.g. line from left to right) without any action of the user, wherein a CCD or CMOS camera system or a mechanically scanning optic is used to focus one effect after the other. The lamp system may use a wireless link between handheld device and system controller. The lamp system may record the lamps in the given sequence. In the lamp system, scene setting may be done by setting parameters for a limited number of lamps and the system controller may deduce from the set-parameters the parameters of all other lamps. In the lamp system, interpolation may be done by turning the color HUE from starting HUE to the end HUE. In the lamp system, multiple rows of lamps may get commissioned row by row. In the lamp system, interpolation of lamp parameters is done in rows of lamps and between the rows. In the lamp system, a commission mode may be started when powered the first time or after a ((full reset)). After the commissioning is finalized it can only be reactivated by erasing all information by means of a ((full reset)). Also, a lamp system comprising lamps, a system controller and a handheld device to allow semi automatic lamp commissioning and scene control is provided, wherein a point and control interaction gets used. This lamp system may make use of a handheld device containing an optical sensor that "sees" a defined area and can be pointed towards an effect to be selected. A handheld device may be provided that detects spatially coded light in the effect and transfers the codes together with user commands to the light system controller. In this lamp system, commissioning may be done by pointing to each lamp or the lamp effect sequence wise and the system records the lamps in the given sequence, and scene setting may be done by setting parameters for a limited number of lamps and the system controller deduces from the set-parameters the parameters of all other lamps. In the lamp system, interpolation may be done by turning the color HUE from starting HUE to the end HUE. In the lamp system, multiple rows of lamps may get commissioned row by row. In the lamp system, interpolation of lamp parameters may be done in rows of lamps and between the rows. Furthermore, a lamp system is provided where the coded light may be only generated during the two interactive modes commissioning and scene setting. During operation the code may not get generated. In the lamp system, after issuing a select button, the system may try to read a code and after timeout of not being able to catch the code it may start to increase brightness of some or all lamps in order to find the lamp selected. Also, a light equipment control interface repeater device may be provided, adapted to modulate a predetermined signal into the data stream delivered to the luminaire, the resulting data stream being based on the received command for this luminaire and the predetermined modulation. The device may be adapted to take a portion of the received commands and deliver at a higher repetition rate a data stream to the luminaire. The device may be adapted to have a selectable mode of operation in which the data stream is based on a finite sequence of data packets with different content, preferably a sequence of three packets, preferably the data within the packed being generated by shifting a predetermined sub-packed trough a set of predetermined positions in the packet. The functionality of the interface repeater device may be integrated into a light system controller. An analysis device may also be provided, having an optical receiver with a dedicated focus spot, adapted to detect the light effect of the luminaire, which is commanded by the before mentioned device. The device may have means to synchronize to the optical response of the luminaire to the sequence of subsets as generated as described before. The device may be adapted to track the position of the light effect the focus of the detector is aimed to according to the changes in the received optical result.

The invention can be applied in any lighting system with a plurality of light sources, for example in lighting systems in homes, shops and office applications. It is particularly suitable for the easy commissioning of light sources, for detecting a light effect position on a wall washer luminaries, and to point and control applications with a handheld device in the lighting system.

At least some of the functionality of the invention may be performed by hard- or software. In case of an implementation in software, a single or multiple standard microprocessors or microcontrollers or digital signal processors may be used to process a single or multiple algorithms implementing the invention.

It should be noted that the word "comprise" does not exclude other elements or steps, and that the word "a" or "an" does not exclude a plurality. Furthermore, any reference signs in the claims shall not be construed as limiting the scope of the invention.

The invention claimed is:

1. A system for controlling a lighting system having a plurality of light sources, the system comprising a light system controller for controlling the light sources so that a spatial light pattern is created, which codes one or more attributes of the light sources, including a unique identifier for each of the light sources a light pattern capturing device for capturing and processing the created spatial light pattern and communicating with the light system controller in order to enable controlling of the light sources based on the captured spatial light pattern, wherein processing of the captured spatial light pattern comprises decoding the unique identifiers of each of the light sources and communicating with the light system controller comprises transmitting the decode unique identifiers from the light pattern capturing device to the light system controller.

2. The system of claim 1, wherein the light system controller is configured to control the light sources by transmitting a control code to the light sources in order to set up the light sources to create the spatial light pattern.

3. The system of claim 1, wherein the light system controller is configured to control the light sources to create temporal changing spatial light patterns in that during a predetermined period of time, different spatial light patterns are created.

4. The system of claim 1, wherein capturing of the created spatial light pattern comprises scanning the created spatial light patterns during the predetermined period of time and processing of the captured spatial light patterns further comprises detecting the pointing position of the light pattern capturing device by analyzing the scanned spatial light patterns in that differences between consecutive spatial light patterns are processed for detecting the pointing position.

5. The system of claim 1, further comprising selecting a number of pointing positions of the light pattern capturing device for adjusting the light effect at these locations, and calculating of interpolated light setting parameters for the light sources located between the selected pointing positions.

6. The system of claim 1, wherein communicating with the light system controller further comprises transmitting a user command instructing the light system controller to commission the light sources in the lighting system based on the captured spatial light pattern.

7. The system of claim 1, wherein communicating with the light system controller further comprises transmitting a user command instructing the light system controller to create a desired lighting scene with the light sources in the lighting system based on the captured spatial light pattern and user inputs.

8. A light pattern capturing device being adapted for application with a system of claim 1 and comprising a spatial light pattern capturing unit being adapted to capture a spatial light pattern created by one or more light sources, a light pattern processing and decoding unit being adapted to decode attributes of the light sources decoded in the captured light pattern, and a communication unit being adapted to communicate decoded attributes to a light system controller for controlling the light sources, to which the received attributes relate.

9. A system for controlling a lighting system having a plurality of light sources, the system comprising a light system controller for controlling the light sources so that a spatial light pattern is created, which codes one or more attributes of the light sources, a light pattern capturing device for capturing the created spatial light pattern and communicating with the light system controller in order to enable the controlling of the one or more light sources based on the captured spatial light pattern, wherein the communicating with the light system controller comprises transmitting a user command instructing the light system controller to create a desired lighting scene with the light sources in the lighting system based on the captured spatial light pattern and user inputs.

10. A system for controlling a lighting system having a plurality of light sources, the system comprising a light system controller for controlling the light sources so that a spatial light pattern is created, which codes one or more attributes of the light sources, a light pattern capturing device for capturing the created spatial light pattern and communicating with the light system controller in order to enable controlling of the light sources based on the captured spatial light pattern, wherein communicating with the light system controller comprises transmitting a user command instructing the light system controller to commission the light sources in the lighting system based on the captured spatial light pattern.

* * * * *